US008814381B2

(12) United States Patent
Ariyoshi et al.

(10) Patent No.: US 8,814,381 B2
(45) Date of Patent: Aug. 26, 2014

(54) OMNIDIRECTIONAL LIGHT EMITTING DEVICE LAMP

(75) Inventors: Tetsuo Ariyoshi, Osaka (JP); Cheon-ho Park, Suwon-si (KR); Byeong-hyeon Yu, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 226 days.

(21) Appl. No.: 13/240,110

(22) Filed: Sep. 22, 2011

(65) Prior Publication Data

US 2012/0307492 A1 Dec. 6, 2012

(30) Foreign Application Priority Data

May 30, 2011 (KR) ..... 10-2011-0051666

(51) Int. Cl.
*F21V 29/00* (2006.01)
*F21K 99/00* (2010.01)

(52) U.S. Cl.
CPC ..... *F21K 9/135* (2013.01); *F21V 29/265* (2013.01)
USPC ..... 362/235; 362/294

(58) Field of Classification Search
None
See application file for complete search history.

(56) References Cited

U.S. PATENT DOCUMENTS

| | | | | |
|---|---|---|---|---|
| 2010/0123397 | A1* | 5/2010 | Tian et al. | 315/113 |
| 2012/0026740 | A1* | 2/2012 | Kim et al. | 362/294 |
| 2012/0033423 | A1* | 2/2012 | Kim et al. | 362/235 |
| 2013/0077303 | A1* | 3/2013 | Ariyoshi et al. | 362/235 |
| 2013/0242566 | A1* | 9/2013 | Kim | 362/308 |
| 2013/0294086 | A1* | 11/2013 | Mayer et al. | 362/298 |

FOREIGN PATENT DOCUMENTS

| | | | |
|---|---|---|---|
| JP | 05-241521 | A | 9/1993 |
| JP | 2006-310057 | A | 11/2006 |
| KR | 95-8226 | A | 4/1995 |
| KR | 10-0898818 | B1 | 5/2009 |
| KR | 10-2010-0122645 | A | 11/2010 |

* cited by examiner

*Primary Examiner* — Britt D Hanley
(74) *Attorney, Agent, or Firm* — Sughrue Mion, PLLC

(57) ABSTRACT

An omnidirectional semiconductor light emitting device lamp has a light distribution characteristic having a large range similar to that of a general incandescent lamp. The semiconductor light emitting device lamp includes a light emitting device for emitting light in all directions and reflection plates arranged at a front surface and a lateral surface of the light emitting device. The light emitted from the light emitting device is reflected from the reflection plate located at the front side and the reflection plate located at the lateral side and emitted to a rear side of the light emitting device. A reflection film is formed on all exposed portions of a surface of the substrate on which the light emitting device is mounted.

19 Claims, 7 Drawing Sheets

OMNIDIRECTIONAL LIGHT EMITTING DEVICE LAMP

CROSS-REFERENCE TO RELATED APPLICATIONS

This application claims the benefit of Korean Patent Application No. 10-2011-0051666, filed on May 30, 2011, in the Korean Intellectual Property Office, the disclosure of which is incorporated herein in its entirety by reference.

BACKGROUND

1. Field

The present disclosure relates to an omnidirectional light emitting device lamp, and more particularly, to an omnidirectional light emitting device lamp having a light distribution characteristic having a large range similar to that of a general incandescent lamp.

2. Description of the Related Art

Light emitting diodes (LEDs) are, for example, semiconductor light emitting devices that convert an electric signal to light using the properties of a compound semiconductor. A semiconductor light emitting device such as an LED, compared to other existing light emitting bodies, has characteristically a long life span and uses a low voltage and simultaneously has low power consumption. Also, a semiconductor light emitting device has merits, for example, a fast response speed and superior shock-resistance, and may be manufactured to be small and light. When necessary, a semiconductor light emitting device is capable of generating light of different wavelengths according to the type and composition of a semiconductor in use. Also, it is a recent trend to replace an existing fluorescent lamp or incandescent lamp with an illumination apparatus using a high brightness light emitting device chip.

For example, an LED bulb may mainly include a base, a heat radiating structure, a driving circuit, a printed circuit board (PCB), an LED, and a cover. The cover is formed of glass having a hemispherical shape, or plastic such as acryl or polycarbonate. Also, to prevent the LED in the bulb from being directly seen, with respect to a glass cover, a white diffusion coating is formed on an inner surface of the glass cover, whereas with a plastic cover, the plastic cover is manufactured of a cover member with a diffusion agent mixed therein to realize a light diffusion effect.

However, an illumination lamp using a semiconductor light emitting device emits light only in a front direction, not in all radial directions in 360 degrees, and thus the light distribution characteristic of the illumination lamp using a semiconductor light emitting device is quite different from that of an incandescent lamp. For example, the above-described LED bulb emits the most amount of light in a forward direction at zero degrees. At greater degrees, the amount of light emission decreases, and the amount of light emission is almost zero at about ±90 degrees. In contrast, in a general incandescent lamp, the amount of light emission hardly decreases and is maintained constant from about zero degrees to about ±130 degrees. Accordingly, while the full width at half maximum of an irradiation angle of the LED bulb is about 130 degrees, the full width at half maximum of a general incandescent lamp is about 260 degrees, which is quite different from that of the LED bulb. The difference is generated because, while a filament used for a general incandescent lamp emits light in all directions in 360 degrees, the LED bulb emits light in the forward direction in about 120 degrees only. Thus, when the LED bulb is used in an existing illumination apparatus, the LED bulb provides users with a distribution of light or a sense of illumination that is quite different from that with which users are familiar. This may be a hindrance to distribution of LED bulbs.

SUMMARY

Provided are methods and apparatuses for an omnidirectional light emitting device lamp having a light distribution characteristic having a large range.

Additional aspects will be set forth in part in the description which follows and, in part, will be apparent from the description, or may be learned by practice of the presented embodiments.

According to an aspect of the present invention, a light emitting device lamp includes first and second substrates arranged to face each other, first and second light emitting devices respectively mounted on two surfaces of the first and second substrates facing each other, and a diffusion cover arranged to surround a space between the first and second substrates.

The light emitting device lamp may further include a first heat sink arranged on a rear surface of the first substrate to dissipate heat from the first light emitting device mounted on the first substrate, and a second heat sink arranged on a rear surface of the second substrate to dissipate heat from the second light emitting device mounted on the second substrate.

The light emitting device lamp may further include a connection member connecting the first and second heat sinks and fixing the first and second heat sinks.

The connection member may be connected to a center portion of the first heat sink and a center portion of the second heat sink by passing through center portions of the first and second substrates.

A plurality of the first light emitting devices may be arranged circumferentially at equal intervals along a circumference of the connection member on the first substrate, and a plurality of the second light emitting devices may be arranged circumferentially at equal intervals along the circumference of the connection member on the second substrate.

The light emitting device lamp may further include a high-reflectance coating formed on a surface of the connection member.

The high-reflectance coating may be a high-reflectance white coating including at least one selected from the group consisting of a foamed PET based material, high-reflectance white polypropylene, and white polycarbonate resin.

The light emitting device lamp may further include a first reflection layer formed on a surface of the first substrate on which the first light emitting device is mounted, and a second reflection layer formed on a surface of the second substrate on which the second light emitting device is mounted.

The first and second reflection films may be high-reflectance white reflection films including at least one selected from the group consisting of a foamed PET based material, high-reflectance white polypropylene, and white polycarbonate resin.

The first reflection film may be formed on all exposed portions of the surface of the first substrate and all exposed portions of a lateral surface of the first light emitting device, except for a light emitting surface of the first light emitting device, and the second reflection film may be formed on all exposed portions of the surface of the second substrate and all exposed portions of a lateral surface of the second light emitting device, except for a light emitting surface of the second light emitting device.

According to another aspect of the present invention, a light emitting device lamp includes a substrate, a light emitting device mounted on the substrate, a diffusion cover arranged to surround the light emitting device, and an upper reflection plate arranged on the diffusion cover to face the light emitting device.

A plurality of the light emitting devices may be arranged on the substrate and the upper reflection plate may be formed sufficiently large to cover an entire arrangement area of the plurality of light emitting devices.

The upper reflection plate may be formed by cutting off a part of the diffusion cover facing the light emitting device and filling a cut area of the diffusion cover, or may be formed on an inner wall of the diffusion cover facing the light emitting device.

The light emitting device lamp may further include a reflection wall arranged on the substrate to surround a circumferential portion corresponding to the light emitting device in the diffusion cover.

The reflection wall may be cylindrical.

The upper reflection plate and the reflection wall may be formed of a high-reflectance white material including at least one selected from the group consisting of a foamed PET based material, high-reflectance white polypropylene, and white polycarbonate resin.

The upper reflection plate may have a diameter that is the same as or greater than that of the reflection wall.

The light emitting device lamp may further include a plurality of support members perpendicularly built on a surface of the substrate or an inner wall of the diffusion cover to support the reflection wall, wherein the reflection wall is separated from the substrate to allow a gap existing between the reflection wall and the surface of the substrate.

The plurality of support members may be formed of a high-reflectance white material or a transparent resin material.

The light emitting device lamp may further include an inner reflection plate arranged in a space in the diffusion cover, the inner reflection plate having a ring disc shape having an opening in a center portion, and a plurality of support members perpendicularly built on a surface of the substrate or an inner wall of the diffusion cover to support the inner reflection wall.

The upper reflection plate and the inner reflection plate may be arranged to have the same center.

A plurality of the light emitting devices may be arranged on the substrate, and a diameter of the opening of the inner reflection plate may be greater than a diameter of an arrangement area of the plurality of light emitting devices.

At least two inner reflection plates may be arranged between the substrate and the upper reflection plate at different heights.

The upper reflection plate may have a diameter that is the same as or greater than an outer diameter of the inner reflection plate.

The upper reflection plate and the inner reflection plate may be formed of a high-reflectance white material including at least one selected from the group consisting of a foamed PET based material, high-reflectance white polypropylene, and white polycarbonate resin.

The plurality of support member may be formed of a high-reflectance white material or a transparent resin material.

The light emitting device lamp may further include a reflection film formed on a surface of the substrate on which the light emitting device is mounted.

The reflection film may be formed of a high-reflectance white material including at least one selected from the group consisting of a foamed PET based material, high-reflectance white polypropylene, and white polycarbonate resin.

The reflection film may be formed on all exposed portions of the surface of the substrate and all exposed portions of a lateral surface of the light emitting device, except for a light emitting surface of the second light emitting device.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
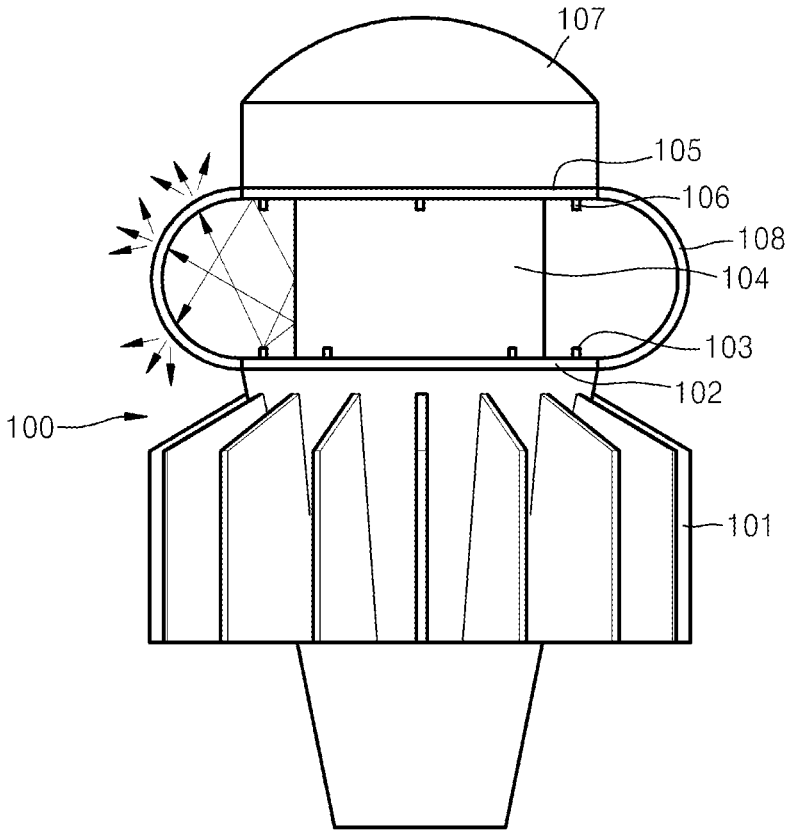
FIG. 1 schematically illustrates a structure of a semiconductor light emitting device lamp according to an embodiment of the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

FIG. 1 schematically illustrates a structure of a semiconductor light emitting device lamp 100 according to an embodiment of the present invention. Referring to FIG. 1, the semiconductor light emitting device lamp 100 may include a lower heat sink 101, an upper heat sink 107, a connection member 104 connecting the lower heat sink 101 and the upper heat sink 107, a first substrate 102 arranged on an upper surface of the lower heat sink 101, a second substrate 105 arranged on a lower surface of the upper heat sink 107, a plurality of lower light emitting devices 103 circumferentially arranged on the first substrate 102, a plurality of upper light emitting devices 106 circumferentially arranged on the second substrate 105, and a diffusion cover 108 arranged to surround a space between the first and second substrates 102 and 105 between the lower heat sink 101 and the upper heat sink 107. The diffusion cover 108 may be a glass cover having an inner wall having a white diffusion coating or a plastic cover in which a diffusion agent is mixedly distributed, as in a related art.

The lower heat sink 101 may be arranged on a lower surface of the first substrate 102 to dissipate heat from the lower light emitting devices 103, whereas the upper heat sink 107 may be arranged on an upper surface of the second substrate 105 to dissipate heat from the upper light emitting devices 106. For efficient radiation of heat, the lower heat sink 101 and the upper heat sink 107 may be formed of metal exhibiting superior thermal conductivity, such as aluminium (Al), or formed of a resin material exhibiting superior thermal conductivity. The connection member 104 penetrates center portions of the first and second substrates 102 and 105 to connect to center portions of the lower and upper heat sinks 101 and 107, thereby fixing the lower and upper heat sinks 101 and 107 to each other. The connection member 104 may be formed of the same material as the lower and upper heat sinks 101 and 107.

The first substrate 102 may be arranged on the upper surface of the lower heat sink 101, whereas the second substrate 105 may be arranged on the lower surface of the upper heat sink 107. For example, the first and second substrates 102 and 105 may each be a PCB substrate in which a wiring pattern is formed on an insulation substrate. The lower light emitting devices 103, which are semiconductor light emitting devices such as LEDs, may be arranged circumferentially at equal intervals around a lower portion of the connection member 104. Likewise, the upper light emitting devices 106 mounted on the second substrate 105 may be arranged circumferentially at equal intervals around an upper portion of the connection member 104. The lower and upper light emitting devices 103 and 106 may be arranged on the two surfaces of the first and second substrates 102 and 105 facing each other. According to the above arrangement, the lower light emitting devices 103 emit light upwardly in the drawing, whereas the upper light emitting devices 106 emit light downwardly in the drawing. Also, the lower and upper light emitting devices 103 and 106 may be alternately arranged not to face each other.

Figure 2:
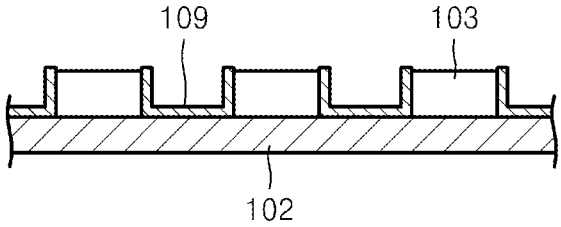
FIG. 2 is a cross-sectional view of a reflection film formed on a substrate of the semiconductor light emitting device lamp of FIG. 1.

To improve light emission efficiency of the light emitting device lamp 100, a surface of the connection member 104 may be coated with a high-reflectance white material. For example, the surface of the connection member 104 may be coated with a foamed PET based material such as microcellular poly ethylene terephthalate (MCPET) or a material such as high-reflectance white polypropylene or white polycarbonate (PC) resin. The reflectance of the white coating formed on the surface of the connection member 104 may be over about 95%. For example, all three of the materials described above have a reflectance of about 97% or higher. Also, the same high-reflectance white coating may be formed on the surfaces of the first and second substrates 102 and 105 on which the lower and upper light emitting devices 103 and 106 are respectively mounted. For example, as illustrated in FIG. 2 a high-reflectance white reflection film 109 may be formed on all exposed portions of the surface of the first substrate 102 and all exposed portions of lateral surfaces of the lower light emitting devices 103, except for light emission surfaces of the lower light emitting devices 103. Although it is not illustrated, the high-reflectance white reflection film 109 may be formed on all exposed portions of the surface of the second substrate 105 and all exposed portions of lateral surfaces of the upper light emitting devices 106, except for light emission surfaces of the upper light emitting devices 106.

In the light emitting device lamp 100 configured as described above, the light emitted from the lower light emitting devices 103 may be emitted outside the light emitting device lamp 100 via, for example, four paths. For example, a first part of the light emitted from the lower light emitting devices 103 may be directly incident on the diffusion cover 108 and diffusively emitted upwardly above the light emitting device lamp 100. Also, a second part of the light emitted from the lower light emitting devices 103 may be reflected by the connection member 104 and diffusively emitted upwardly above and relatively sideward the light emitting device lamp 100 through the diffusion cover 108. A third part of the light emitted from the lower light emitting devices 103 may be sequentially reflected by the connection member 104 and the surface of the second substrate 105 and diffusively emitted downwardly under and relatively sideward the light emitting device lamp 100 through the diffusion cover 108. A fourth part of the light emitted from the lower light emitting devices 103 may be reflected by the surface of the second substrate 105 and diffusively emitted downwardly under the light emitting device lamp 100 through the diffusion cover 108. The light emitted from the upper light emitting devices 106 may be emitted outside the light emitting device lamp 100 via paths similar to the above paths.

Figure 3:
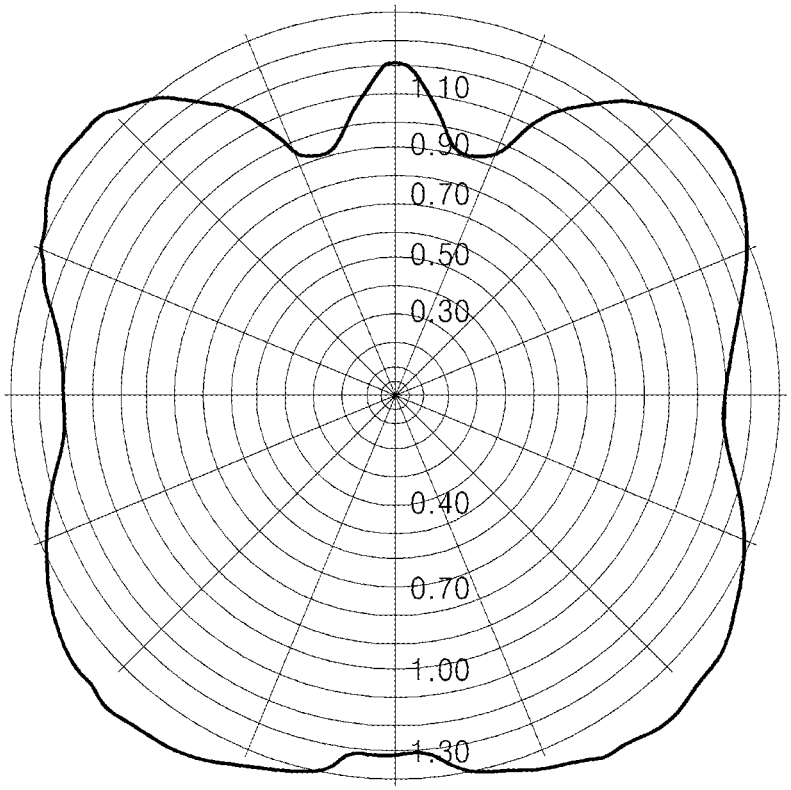
FIG. 3 illustrates a light distribution curve of the semiconductor light emitting device lamp of FIG. 1.

Thus, in the semiconductor light emitting device lamp 100 according to the present embodiment, the light emitted from the lower and upper light emitting devices 103 and 106 may be irradiated in all directions with respect to the semiconductor light emitting device lamp 100. FIG. 3 illustrates a light distribution curve of the semiconductor light emitting device lamp 100. As can be seen from FIG. 3, the light emitting device lamp 100 according to the present embodiment has a light distribution characteristic close to that of an incandescent lamp.

Figure 4:
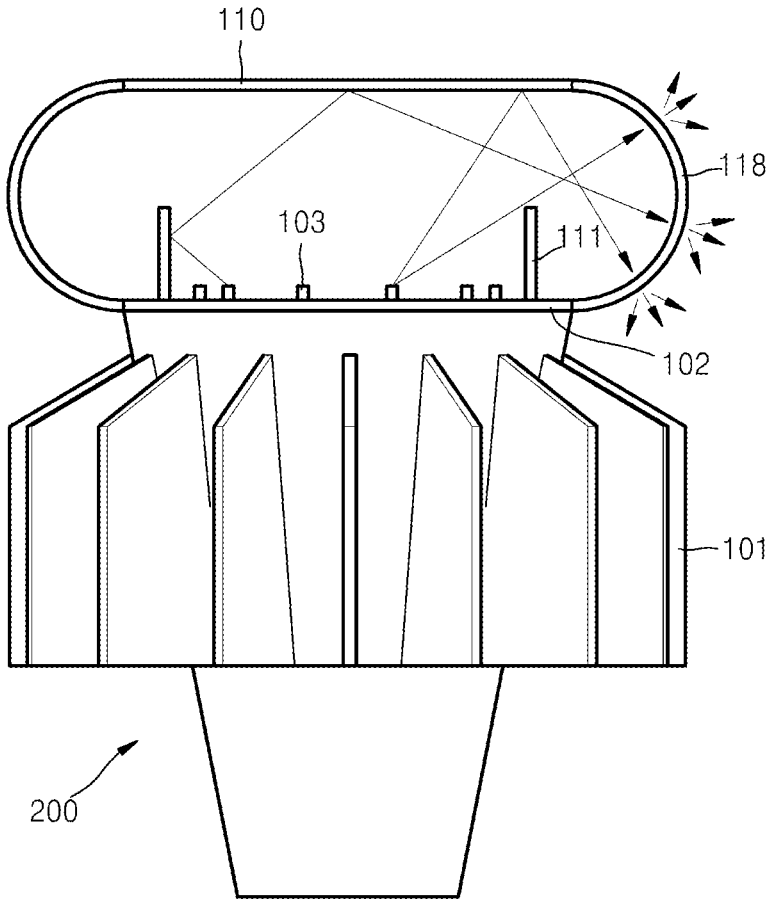
FIG. 4 schematically illustrates a structure of a semiconductor light emitting device lamp according to another embodiment of the present invention.

FIG. 4 schematically illustrates a structure of a semiconductor light emitting device lamp 200 according to another embodiment of the present invention. Referring to FIG. 4, the semiconductor light emitting device lamp 200 according to the present embodiment may include a heat sink 101, a substrate 102 arranged on a surface of the heat sink 101, a plurality of light emitting devices 103 arranged on the substrate 102, a diffusion cover 118 arranged to surround the light emitting devices 103, and an upper reflection plate 110 arranged to face the light emitting devices 103. The semiconductor light emitting device lamp 200 according to the present embodiment may also include a reflection wall 111 arranged on the substrate 102 to surround an outer circumferential portion corresponding to the light emitting devices 103.

The diffusion cover 118 may be a glass cover having an inner wall that has a white diffusion coating or a plastic cover in which a diffusion agent is mixedly distributed. The heat sink 101 may be formed of metal exhibiting superior thermal conductivity, such as aluminium (Al), or formed of a resin material exhibiting superior thermal conductivity. Also, the substrate 102 may be a PCB substrate in which a wiring pattern is formed on an insulation substrate. The light emitting devices 103, which may be LEDs, may be arranged on the substrate 102, for example, in a circumferential form. However, the light emitting devices 103 may be arranged in an array having rows and columns. Although it is not illustrated in FIG. 4, a reflection film may be further formed on a surface of the substrate 102. For example, as illustrated in FIG. 2, the high-reflectance white reflection film 109 may be formed on all exposed portions of the surface of the substrate 102 and all exposed portions of lateral surfaces of the light emitting devices 103, except for light emission surfaces of the light emitting devices 103.

Figure 5:
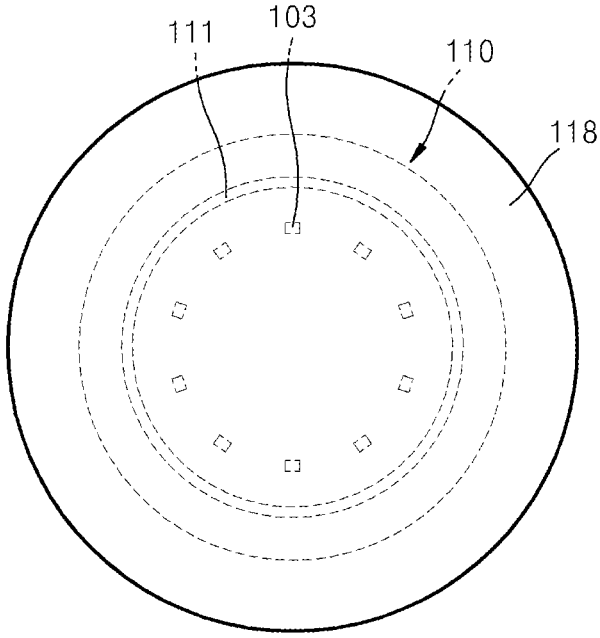
FIG. 5 is a plan view schematically illustrating a structure of the semiconductor light emitting device lamp of FIG. 4.

According to the present embodiment, the upper reflection plate 110 may be circular and larger than the arrangement of the light emitting devices 103. For example, referring to FIG. 5, the light emitting devices 103 are arranged in a circumferential form and the upper reflection plate 110 is formed in a circular form larger than the circumferential form. That is, the upper reflection plate 110 may be sufficiently large to cover the entire arrangement of the light emitting devices 103, thereby facing all of the light emitting devices 103. Also, the reflection wall 111 may be formed in a cylindrical form larger than the arrangement of the light emitting devices 103. Referring to FIG. 5, the reflection wall 111 is formed in a cylindrical form surrounding the light emitting devices 103. As illustrated in FIG. 5, the upper reflection plate 110 may be formed in a circular form larger than the reflection wall 111 of a cylindrical form. However, the circular upper reflection plate 110 and the cylindrical reflection wall 111 may have the same diameter.

The upper reflection plate 110 and the reflection wall 111 may be formed of, for example, a foamed PET based material such as MCPET, or a material such as high-reflectance white polypropylene or white PC resin. The reflectance of the upper reflection plate 110 and the reflection wall 111 may be over about 95%. For example, all three materials described above have a reflectance of about 97% or higher. The upper reflection plate 110, as illustrated in FIG. 4, may be formed by cutting off a part of the diffusion cover 118 facing the light emitting devices 103 and filling a cut area of the diffusion cover 118. However, instead of cutting off the diffusion cover 118, the upper reflection plate 110 may be coated on an inner wall of the diffusion cover 118 facing the light emitting devices 103.

In the light emitting device lamp 200 configured as described above, light emitted from the light emitting devices 103 may be emitted outside the light emitting device lamp 200 via a variety of paths. For example, a first part of the light emitted from the light emitting devices 103 may be sequentially reflected from the reflection wall 111 and the upper reflection plate 110 and diffusively emitted downwardly under and relatively sideward the light emitting device lamp 200 through the diffusion cover 118. Also, a second part of the light emitted from the lower light emitting devices 103 may be directly incident on the diffusion cover 118 and diffusively emitted upwardly above the light emitting device lamp 200. A third part of the light emitted from the lower light emitting devices 103 may be reflected from the upper reflection plate 110 and diffusively emitted downwardly under the light emitting device lamp 200 through the diffusion cover 118. The light emitted from the light emitting devices 103 may travel in a variety of paths other than the above-described paths. For example, a part of the light may be reflected from the upper reflection plate 110 and reflected again from the reflection film 109 (see FIG. 2) formed on the surface of the substrate 102, and then emitted outside the light emitting device lamp 200. Also, a part of the light may be repeatedly reflected between the upper reflection plate 110, the reflection wall 111, and the reflection film 109, and then emitted outside the light emitting device lamp 200 through the diffusion cover 118.

Figure 6:
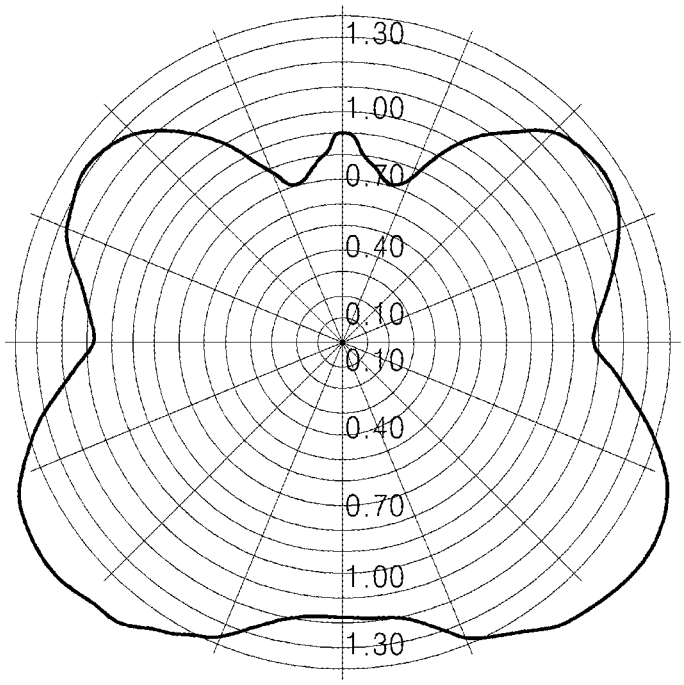
FIG. 6 illustrates a light distribution curve of the semiconductor light emitting device lamp of FIG. 4.

Thus, in the light emitting device lamp 200 according to the present embodiment illustrated in FIGS. 4 and 5, since the light emitted from the light emitting devices 103 travel via various paths, the light may be more uniformly irradiated in all directions with respect to the light emitting device lamp 200. FIG. 6 illustrates a light distribution curve of the semiconductor light emitting device lamp 200. As can be seen from FIG. 6, the light emitting device lamp 200 according to the present embodiment illustrated in FIGS. 4 and 5 also has a light distribution characteristic close to that of an incandescent lamp.

Figure 7:
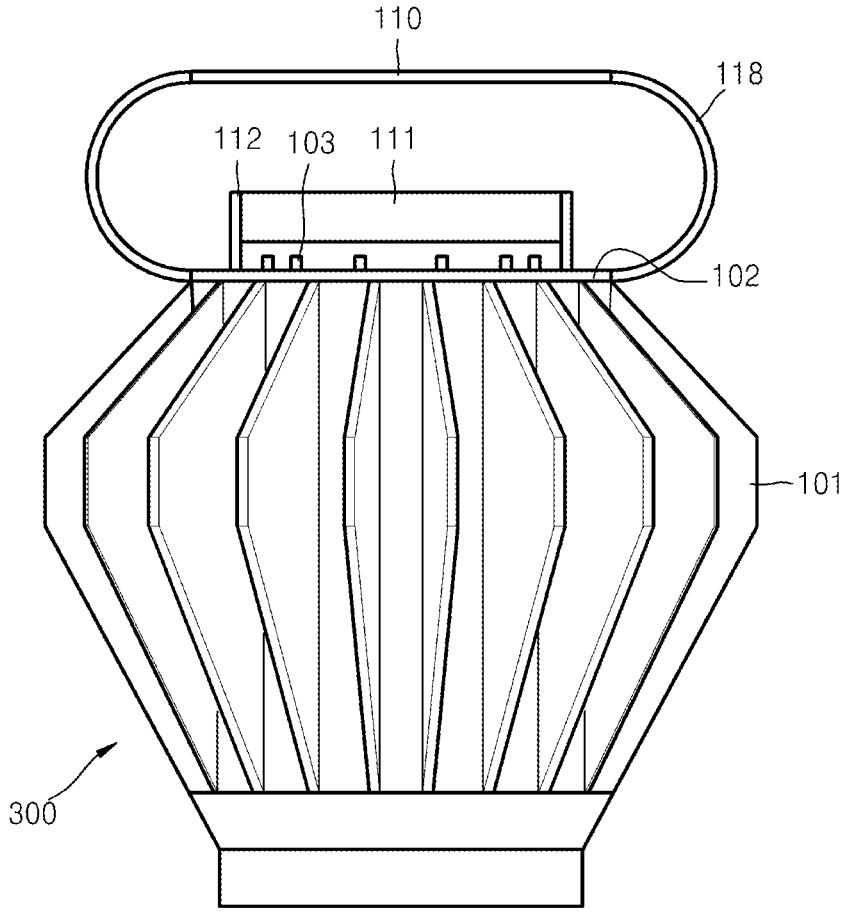
FIG. 7 schematically illustrates a structure of a semiconductor light emitting device lamp according to another embodiment of the present invention.

FIG. 7 schematically illustrates a structure of a semiconductor light emitting device lamp 300 according to another embodiment of the present invention. The semiconductor light emitting device lamp 300 has almost the same structure as the light emitting device lamp 200 of FIGS. 4 and 5 and is different only in that the reflection wall 111 is separated from the surface of the substrate 102. That is, although in the embodiment of FIG. 4 the reflection wall 111 is arranged on the surface of the substrate 102 without a gap therebetween, in the embodiment of FIG. 7, a gap exists between the reflection wall 111 and the surface of the substrate 102. Typically, the light emitting device 103 hardly emits light in a lateral direction at 90 degrees, but emits a large amount of light in a forward direction. Thus, even when a slight gap exists between the reflection wall 111 and the surface of the substrate 102, the gap does not affect performance of the semiconductor light emitting device lamp 300. Rather, the gap may further improve reflection efficiency of the reflection wall 111. To this end, the reflection wall 111 may be supported by a plurality of support members 112 perpendicularly built on the surface of the substrate 102. Alternately, the support members 112 may be built perpendicularly on an inner wall of the diffusion cover 118. According to an embodiment of the present invention, surfaces of the support members 112 may be coated with the above-described high-reflectance white material or the support members 112 may be wholly formed of the above-described high-reflectance white material. Alternately, the support members 112 may be formed of a transparent resin material.

Figure 8:
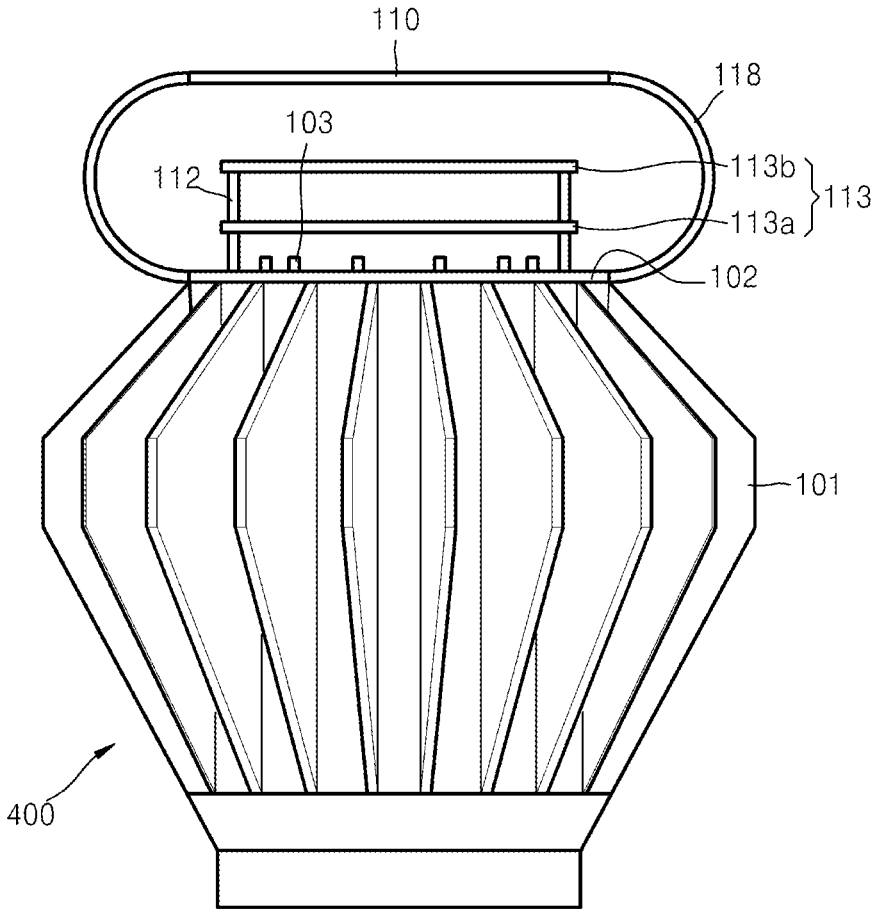
FIG. 8 schematically illustrates a structure of a semiconductor light emitting device lamp according to another embodiment of the present invention.
Figure 9:
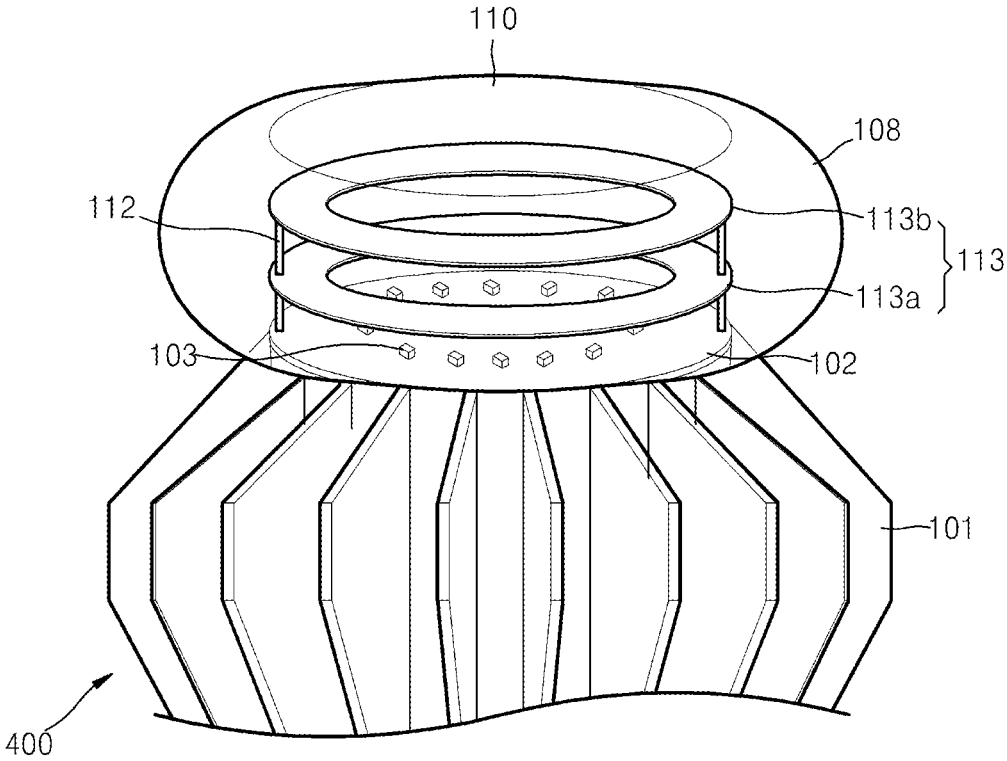
FIG. 9 is a perspective view schematically illustrating a structure of the semiconductor light emitting device lamp of FIG. 8.

FIGS. 8 and 9 schematically illustrate a structure of a semiconductor light emitting device lamp 400 according to another embodiment of the present invention. Like the semiconductor light emitting device lamp 200 of FIG. 4, the semiconductor light emitting device lamp 400 of FIGS. 8 and 9 includes the heat sink 101, the substrate 102 arranged on the surface of the heat sink 101, the light emitting devices 103 arranged on the substrate 102, the diffusion cover 118 arranged to surround the light emitting devices 103, and the upper reflection plate 110 arranged to face the light emitting devices 103. However, the semiconductor light emitting device lamp 400 of FIGS. 8 and 9 is different from the semiconductor light emitting device lamp 200 of FIG. 4 in that an inner reflection plate 113 having a ring disc shape is included in the diffusion cover 118 instead of the cylindrical reflection wall 111 of FIG. 4. Other elements of the semiconductor light emitting device lamp 400 may be identical to those of the light emitting device lamp 200 of FIGS. 4 and 5.

Referring to FIG. 9, the inner reflection plate 113 is in the form of a ring disc, that is, a disc having a center portion cut away a doughnut-shaped disc, and two inner reflection plates 113 are arranged between the substrate 102 and the upper reflection plate 110 at different heights. Although two inner reflection plates 113 are illustrated in FIG. 9, there may instead be one or three or more inner reflection plates 113. The upper reflection plate 110 and the two inner reflection plates 113 may be arranged to have the same center. In an embodiment of the present invention, the diameter of the upper reflection plate 110 may be greater than the outer diameter of the inner reflection plate 113. However, the diameter of the upper reflection plate 110 may be the same as the outer diameter of the inner reflection plate 113. In the meantime, the inner diameter of the inner reflection plate 113, that is, the diameter of an opening formed at the center of the ring disc, may be larger than the arrangement of the light emitting devices 103. That is, the light emitting devices 103 may be arranged within an opening area of the inner reflection plate 113. The inner reflection plate 113 may be formed of the above-described high-reflectance white material, for example, a foamed PET based material such as MCPET, or a material such as high-reflectance white polypropylene or white PC resin. Also, the inner reflection plate 113 may be supported by the support members 112 perpendicularly built on the surface of the substrate 102. Alternately, the support members 112 may be built perpendicularly on the inner wall of the diffusion cover 118. According to an embodiment of the present invention, the surfaces of the support members 112 may be wholly formed of the above-described high-reflectance white material. Alternately, the support members 112 may be formed of a transparent resin material.

In the structure of the light emitting device lamp 400, the light emitted from the light emitting devices 103 may be irradiated outside the light emitting device lamp 400 via a variety of paths. For example, a part of the light emitted from the light emitting devices 103 may be reflected from a lower inner reflection plate 113*a* and diffusively emitted downwardly under the light emitting device lamp 400 through the diffusion cover 118. Also, another part of the light may be reflected from an upper inner reflection plate 113*b* and diffusively emitted downwardly under the light emitting device lamp 400 through the diffusion cover 118. Another part of the light may be reflected from the upper reflection plate 110 and diffusively emitted downwardly under the light emitting device lamp 400 through the diffusion cover 118. Another part of the light may be sequentially reflected from the upper inner reflection plate 113*b* and the lower inner reflection plate 113*a* and diffusively emitted upwardly above and relatively sideward the lateral side of the light emitting device lamp 400 through the diffusion cover 118. Another part of the light may be sequentially reflected from the upper reflection plate 110 and the upper inner reflection plate 113*b* and diffusively emitted upwardly above the light emitting device lamp 400 through the diffusion cover 118. Thus, in the light emitting device lamp 400 according to the embodiment of FIGS. 8 and 9, the light emitted from the light emitting devices 103 travels via various paths so as to be uniformly irradiated in all directions with respect to the light emitting device lamp 400.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A light emitting device lamp comprising:

a substrate;

a light emitting device mounted on the substrate;

a diffusion cover arranged to surround the light emitting device; and an upper reflection plate arranged on the diffusion cover to face the light emitting device.

2. The light emitting device lamp of claim 1, wherein a plurality of the light emitting devices are arranged on the substrate and the upper reflection plate is formed sufficiently large to cover an entire arrangement area of the plurality of light emitting devices.

3. The light emitting device lamp of claim 2, wherein the upper reflection plate is formed by cutting off a part of the diffusion cover facing the light emitting device and filling a cut area of the diffusion cover, or is formed on an inner wall of the diffusion cover facing the light emitting device.

4. The light emitting device lamp of claim 1, further comprising a reflection wall arranged on the substrate to surround a circumferential portion corresponding to the light emitting device in the diffusion cover.

5. The light emitting device lamp of claim 4, wherein the reflection wall is cylindrical.

6. The light emitting device lamp of claim 4, wherein the upper reflection plate and the reflection wall are formed of a high-reflectance white material comprising at least one selected from the group consisting of a foamed PET based material, high-reflectance white polypropylene, and white polycarbonate resin.

7. The light emitting device lamp of claim 4, wherein the upper reflection plate has a diameter that is the same as or greater than a diameter of the reflection wall.

8. The light emitting device lamp of claim 4, further comprising a plurality of support members perpendicularly built on a surface of the substrate or an inner wall of the diffusion cover to support the reflection wall, wherein the reflection wall is separated from the substrate by a gap between the reflection wall and the surface of the substrate.

9. The light emitting device lamp of claim 8, wherein the plurality of support members are formed of a high-reflectance white material or a transparent resin material.

10. The light emitting device lamp of claim 1, further comprising:

an inner reflection plate arranged in a space in the diffusion cover, the inner reflection plate having a ring disc shape having an opening in a center portion; and a plurality of support members perpendicularly built on a surface of the substrate or an inner wall of the diffusion cover to support the inner reflection wall.

11. The light emitting device lamp of claim 10, wherein the upper reflection plate and the inner reflection plate are arranged to have the same center.

12. The light emitting device lamp of claim 11, wherein a plurality of the light emitting devices are arranged on the substrate, and a diameter of the opening of the inner reflection plate is greater than a diameter of an arrangement area of the plurality of light emitting devices.

13. The light emitting device lamp of claim 11, wherein at least two inner reflection plates are arranged between the substrate and the upper reflection plate at different heights.

14. The light emitting device lamp of claim 11, wherein the upper reflection plate has a diameter that is the same as or greater than an outer diameter of the inner reflection plate.

15. The light emitting device lamp of claim 10, wherein the upper reflection plate and the inner reflection plate are formed of a high-reflectance white material comprising at least one selected from the group consisting of a foamed PET based material, high-reflectance white polypropylene, and white polycarbonate resin.

16. The light emitting device lamp of claim 10, wherein the plurality of support member are formed of a high-reflectance white material or a transparent resin material.

17. The light emitting device lamp of claim 1, further comprising a reflection film formed on a surface of the substrate on which the light emitting device is mounted.

18. The light emitting device lamp of claim 17, wherein the reflection film is formed of a high-reflectance white material comprising at least one selected from the group consisting of a foamed PET based material, high-reflectance white polypropylene, and white polycarbonate resin.

19. The light emitting device lamp of claim 17, wherein the reflection film is formed on all exposed portions of the surface of the substrate and all exposed portions of a lateral surface of the light emitting device, except for a light emitting surface of the light emitting device.

* * * * *